United States Patent [19]

Gerhard et al.

[11] 4,253,046

[45] * Feb. 24, 1981

[54] VARIABLE INTENSITY CONTROL APPARATUS FOR OPERATING A GAS DISCHARGE LAMP

[75] Inventors: Francis H. Gerhard, San Juan Capistrano; Gerald A. Felper, Anaheim, both of Calif.

[73] Assignee: Datapower, Inc., Santa Ana, Calif.

[ * ] Notice: The portion of the term of this patent subsequent to Sep. 18, 1996, has been disclaimed.

[21] Appl. No.: 968,372

[22] Filed: Dec. 11, 1978

Related U.S. Application Data

[63] Continuation-in-part of Ser. No. 865,209, Dec. 28, 1977, Pat. No. 4,168,453, and a continuation-in-part of Ser. No. 940,435, Sep. 7, 1978.

[51] Int. Cl.[3] ..... H05B 41/36

[52] U.S. Cl. ..... 315/224; 315/105; 315/276; 315/307; 315/335; 315/DIG. 7

[58] Field of Search ..... 315/105, 208, 209 R, 315/219, 224, 276, 291, 307, 311, 335, DIG. 4, DIG. 7

[56] References Cited

U.S. PATENT DOCUMENTS

| | | | |
|---|---|---|---|
| 3,619,713 | 11/1971 | Biega | 315/DIG. 7 |
| 3,906,302 | 9/1975 | Wijsboom | 315/289 X |
| 4,168,453 | 9/1979 | Gerhard et al. | 315/291 X |

*Primary Examiner*—Eugene R. LaRoche

*Attorney, Agent, or Firm*—Knobbe, Martens, Olson, Hubbard & Bear

[57] ABSTRACT

A gas discharge lamp is connected across a step down auto transformer and in series with a solid state switching device and a resistor, and this combination is connected across a rectified AC voltage source. This switching device is controlled by a monostable multivibrator, the input of which is connected to the output of a comparator amplifier sensing the difference between the voltage drop across the above-mentioned resistor and a voltage which may be selected to vary light intensity. A starter aid conductor is placed adjacent the lamp and connected to the grounded side of the voltage source. This results in an efficient, high frequency operation of the lamp wherein the voltage gradient inside the lamp during starting ignition of the lamp is greatly increased to facilitate ignition despite the presence of the step down auto transformer, thereby permitting a decrease in the minimum fly back voltage necessary to start the lamp. As a result, reliability is increased.

11 Claims, 9 Drawing Figures

Fig. 1
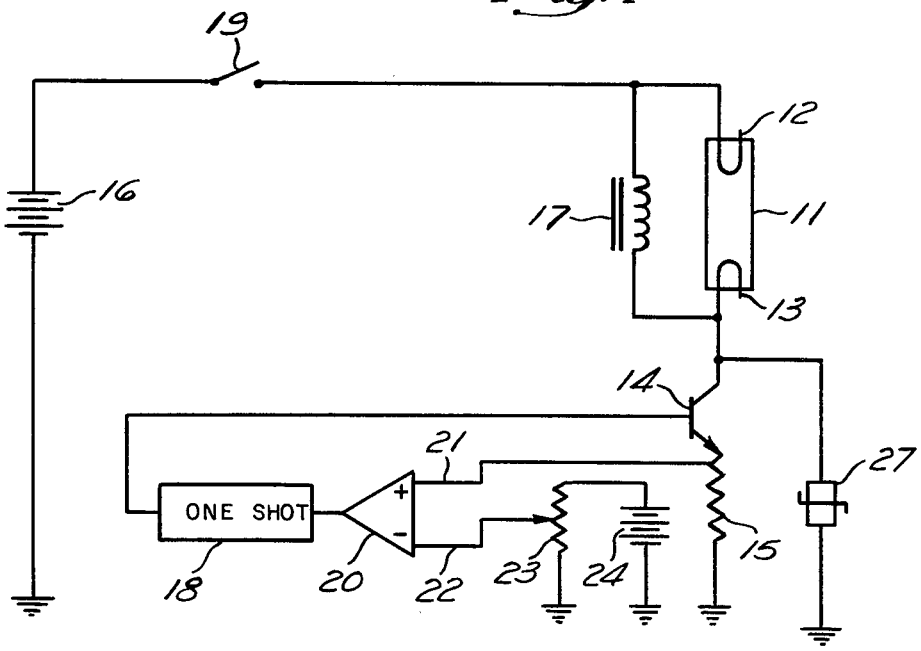
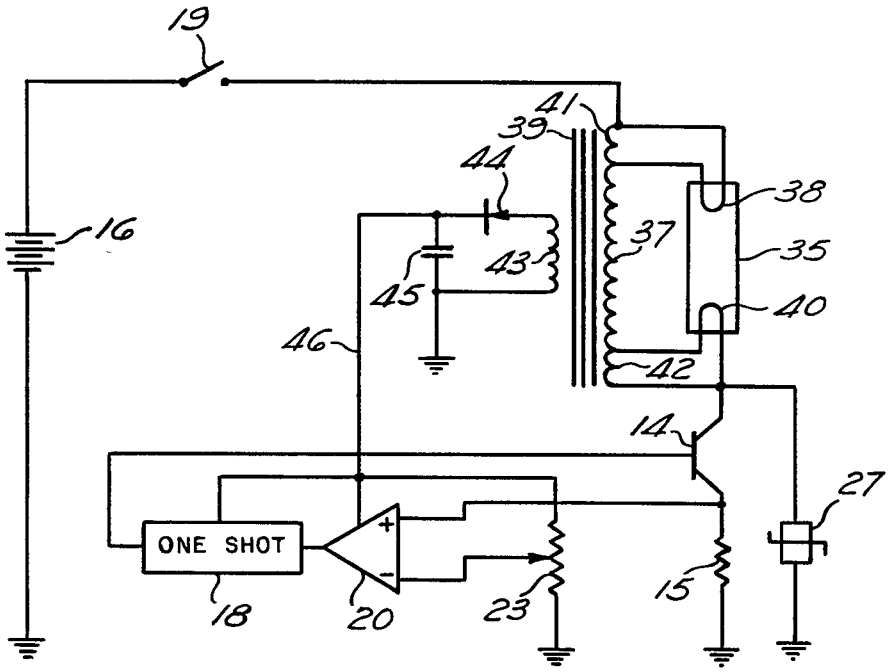
Fig. 3

VARIABLE INTENSITY CONTROL APPARATUS FOR OPERATING A GAS DISCHARGE LAMP

RELATED APPLICATION

This is a continuation-in-part of our co-pending application, Ser. No. 865,209, filed Dec. 28, 1977, U.S. Pat. No. 4,168,453, issued Sept. 18, 1979 and a companion case to an additional continuation-in-part of the same parent application, namely Ser. No. 940,435, filed Sept. 7, 1978.

BACKGROUND OF THE INVENTION

1. Field of the Invention

This invention relates to apparatus for operating a gas discharge lamp, such as a fluorescent light, a mercury vapor lamp, a sodium lamp, or a metal halide lamp.

2. Description of the Prior Art

Control circuits for gas discharge lamps are known which obviate the need for the usual heavy and expensive series ballast devices, corresponding to the inductor in this device. In such circuits, switching elements are provided to periodically reverse the direction of current through the lamp to reduce the deterioration or errosion of electrodes, and to ensure a high enough frequency of switching to reduce the requirement for the size of the ballast. Such circuits generally require two switching elements for each direction of the current.

Attempts have been made to fabricate the same type of circuit using only a single switching element to cause current reversal in the lamp. For example, the patent to D. B. Wijsboom, U.S. Pat. No. 3,906,302, is directed to such an arrangement and incorporates an inductor in parallel with the lamp, which lamp is in series with a switching device. Such a switching device is generally operated at relatively high frequencies, such as 20 kHz.

One problem has been that the fly back voltage during current reversal required to ignite the lamp when the circuit is first activated must be large enough to generate a sufficiently strong voltage gradient in the lamp to ionize the gas. This causes a large voltage to appear across the switching device which can damage the device during ignition, thereby limiting the reliability of the control circuit.

Another problem has been that it is often necessary to reduce the voltage supplied to the circuit in order to ensure that only the optimum lamp voltage is supplied to the lamp. It has been found that such a reduction in supply voltage decreases the voltage gradient in the lamp for starting ignition of the lamp during current reversal. Therefore, with the introduction of a step down auto transformer, the fly back voltage of the circuit must be increased to provide a sufficient voltage gradient in the lamp. Such an increase in fly back voltage increases the wear in components in the circuit and a consequent loss of reliability.

SUMMARY OF THE INVENTION

One electrode of a gas discharge lamp is connected to the tapped output of a step down auto transformer. One end of the auto transformer is connected to a rectified power source and the other end is connected to the collector of a transistor switch and to the other electrode of the gas discharge lamp. The emitter of the transistor is connected to one end of a resistor, and the other end of the resistor is connected to the AC power supply return. The base of the transistor is connected to the output of a monostable or one-shot multivibrator. The input to the one-shot multivibrator is connected to the output of a comparator amplifier. The multivibrator operates in such a way that when the input to the multivibrator is high, the multivibrator is triggered and its output goes low for a predetermined amount of time, after which its output returns to the high state. The two inputs to the comparator amplifier are connected in such a way that one input is connected to the emitter of the transistor and the other input is connected to a voltage source which may be varied or controlled. The circuit components and the time delay of the multivibrator are chosen in such a way as to provide a relatively high rate of switching on the base of the transistor, approximately 20 to 40 kHz. A starter aid conductor is mounted adjacent the lamp and connected to the power supply return.

A significant feature of this invention is that the voltage gradient in the lamp during ignition may be maximized without regard to the step down ratio of the auto transformer, while the fly back voltage required for lamp ignition may be decreased. This reduces the fly back voltage across the transistor and therefore enhances the reliability of the circuit, while permitting the use of an auto transformer with any desired step down ratio.

BRIEF DESCRIPTION OF THE DRAWINGS

The invention will be described in detail with reference to the accompanying drawings in which:

FIG. 1 illustrates an embodiment of a control circuit for a gas discharge lamp shown in simplified form for facilitating an understanding of the overall function of the control apparatus;

FIG. 2 shows four waveform plots labeled 2A, 2B, 2C, and 2D which are characteristic of the control circuit illustrated in FIG. 1.

FIG. 3 illustrates a modified form of the control circuit of FIG. 1 in which the choke or inductor windings are used as the primary windings of a step down transformer which supplies power for the one-shot multivibrator and the comparator amplifier as well as the reference voltage to the input of the comparator amplifier. FIG. 3 also illustrates the use of the primary coil as an auto transformer to supply current to the electrodes of the gas discharge lamp as a source of preheating current prior to ignition of the lamp;

DESCRIPTION OF THE PREFERRED EMBODIMENT

Figure 2A:
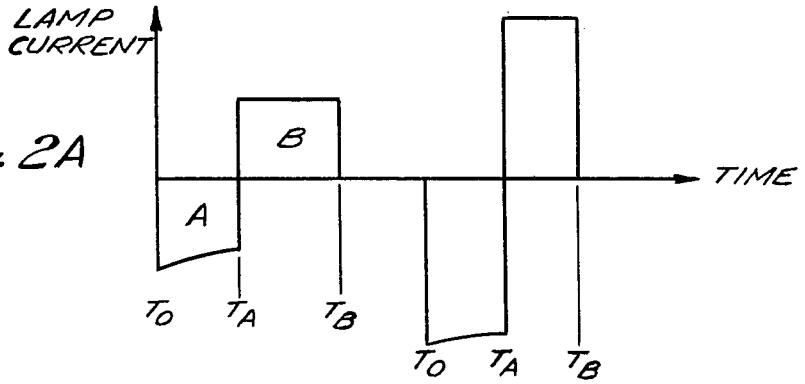
FIG. 2A is a plot of the current through the gas discharge lamp as a function of time.

Referring to the circuit illustrated in FIG. 1, a gas discharge lamp 11, typically a low-pressure mercury vapor fluorescent lamp, having two electrodes 12 and 13, has its electrode 13 connected to an electronic switch shown as an NPN transistor 14, the collector of which is connected to electrode 13, and the emitter connected to a resistor 15. The other end of the resistor 15 is connected to ground. The other electrode of the gas discharge tube 12 is connected to a DC power supply. This supply will normally be a rectified AC source but is shown for simplicity in this figure as a battery 16 whose positive terminal is connected through on-off switch 19 to electrode 12 and whose negative terminal is connected to ground. A choke or inductor 17 is connected in parallel with the electrodes of the gas discharge lamp 12 and 13.

The base of the NPN transistor switch 14 is connected to the output of a one shot multivibrator 18. The monostable multivibrator operates in such a way that when the input to the multivibrator is low its output is high, and when its input is high, the monostable multivibrator is triggered such that its output goes into the low state for a predetermined finite length of time, after which the output of the multivibrator returns to the high state. The input of the multivibrator is connected to the output of a comparator amplifier 20. The positive input of the comparator amplifier is connected through a conductor 21 to the emitter of the NPN transistor 14, and the negative input of the comparator amplifier is connected through a conductor 22 to a potentiometer 23. Potentiometer 23 is connected to the positive end of a DC power source 24, and the negative end of the DC power source 24 is connected to ground.

The operation of the circuit of FIG. 1 is as follows. When the switch 19 is first closed, the current passes through the switch 19 and through the inductor 17. No current passes through the gas discharge lamp 11 because, until it is ignited by high voltage, the lamp remains nonconductive. The current through the inductor passes through the NPN transistor switch 14 and through the resistor 15 to ground. The current through the inductor 17 rises as a function of time until it reaches a level at which the voltage drop across the resistor 15 exceeds the voltage on the conductor 22. The voltage on the conductor 22 is determined by the potentiometer 23. When the voltage drop across the resistor 15 exceeds the voltage on the conductor 22, the comparator amplifier 20 senses a positive difference between its inputs and the output of the comparator amplifier 20 changes from the low to the high state. In response to the high output of the comparator amplifier 20, the one shot multivibrator 18, is triggered and provides a low output for a short predetermined length of time. Thus, the transistor switch 14 will be turned off for the short period of time during which the base of the transistor receives a low level signal from the multivibrator 18. The magnetic field in the choke 17 then collapses, resulting in a fly back voltage potential across the electrodes 12 and 13 of the gas discharge lamp 11. This potential is sufficient to ignite the lamp and the lamp begins to conduct current. The fly back voltage is also applied to the collector of the transistor 14.

After the above-mentioned short predetermined length of time, the one shot multivibrator output returns to its normally high level state, thereby turning the transistor switch 14 back on. At this instance in time, current begins to flow from the source 16 through the electrodes 12 and 13 of the gas discharge lamp 11 in the opposite direction to the current supplied before by the choke 17. The magnetic field in the choke 17 also begins to build up again as does the current through the choke 17. This results in a rise in the collector current of the transistor 14 and an equal rise in current through the resistor 15. This rise in current will cause the voltage drop across resistor 15 to rise until the conductor 21 again exceeds the voltage on conductor 22. Again, the comparator amplifier 20 will give a high output when this condition is reached, causing the output of the multivibrator 18 to go into the low state for the finite period of time thereby turning off the collector current of the transistor 14. The magnetic field in the choke 17 will collapse at this time, thereby causing a current to flow between the electrodes 12 and 13 of the gas discharge lamp 11 in a direction opposite to the direction traveled by the current when the transistor 14 was on. This condition will continue until the multivibrator output remains automatically to the high state.

As may be seen from this description, this process will continue to repeat itself as the transistor 14 continuously is switched on and off until steady state conditions are achieved. One or more cycles of operation may be required to ionize the lamp and cuase it to ignite.

A varistor or high voltage zener diode 27 is connected between the collector of the NPN transistor and ground, and serves to protect the transistor 14 from destructive breakdown in the event of lamp failure causing an open circuit between its terminals, or inadvertent unplugging of the lamp when the power switch 19 is closed. When the lamp itself is defective and causes an open circuit or when the lamp is removed, the voltage rise at the collector of transistor 14 produced by collapse of the magnetic field in the inductor 17 will be limited to the breakdown voltage of the varistor, a value selected to be within the safe limits of the collector-base junction of the transistor switch 14.

A significant feature of the invention is that the varistor 27 serves the additional function of preventing ignition of the lamp until the lamp electrodes have been warmed up over a time period which is long compared to the operating period of the control circuit. Thus, the control circuits of this invention, without the varistor, would typically supply on the order of 1000 volts across the lamp in the fly back mode. Such high voltage applied to the lamp filaments when they are cold would be extremely deleterious since the electrodes would undergo a very high rate of change of temperature. The varistor is selected such that it breaks down for voltages exceeding 500 to 600 volts. At these lower voltages, the lamp 11 will not ignite until after the cathodes have been heated. Typically, a time delay of ¾ second to one second is the amount of time needed to heat up the cathodes sufficiently for the lamp to ignite when supplied with 500 to 600 volts.

FIGS. 2A, 2B, 2C, and 2D are plots of the steady state response characteristics of the circuit for two different levels of input power to the gas discharge lamp.

FIG. 2A is a plot of a single cycle of current through the gas discharge lamp as a function of time. The current is plotted on the vertical axis and the time is plotted on the horizontal axis. It will be understood that the current alternates through the lamp in a repetitive cycle. In the region of FIG. 2A, denoted "A", the transistor switch 14 is in the off state and the collapsing field in the inductor 17 is forcing a current through the gas discharge lamp. The region A covers a period of time between time $T_O$ and time $T_A$. This time period is equal to the unstable period of multivibrator 18. In the region in FIG. 2A denoted "B", the transistor switch 14 is on. The region B lies between the time $T_A$ and the time $T_B$, after which the cycle repeats itself.

In FIG. 2A, the magnitude of the lamp current in region A is shown to be roughly equal to the magnitude of the current in region B. Since, for reasons described above, there is no net DC current through the lamp, the respective areas under the curves in regions A and B are equal. Thus, in the circuit operating mode illustrated by FIG. 2A, the duration of the time periods A and B are roughly equal. The operational mode shown in FIG. 3A having approximately equal current flows in regions A and B is advantageous since it maximizes the efficiency of the lamp and also minimizes the current handling requirements for the switch transistor 14. This operating mode is achieved for a fairly narrow range of DC voltage output of the power source 16 for a given lamp. The circuit of FIG. 4 described below provides a means for matching a given DC voltage to a plurality of lamp or lamps having different optimum voltages.

Figure 2B:
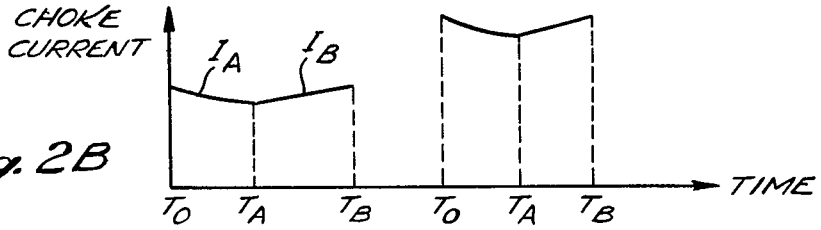
FIG. 2B is a plot of the current through the choke or inductor as a function of time.

FIG. 2B is a lot of the current through the choke or inductor 17 as a function of time. The current through the choke is plotted on the vertical axis, while time is plotted on the horizontal axis. In the region of FIG. 2B denoted "A", at time $T_O$, the transistor has been turned off and the current through the choke is decaying as a function of time until time $T_A$. At time $T_A$, the transistor is turned on. The current through the choke in the region of FIG. 2B denoted "B" increases until time $T_B$, at which time the transistor is turned back off, and the cycle repeats itself. The behavior of the circuit thus alternates between the behavior plotted in region A and the behavior plotted in region B.

Figure 2C:
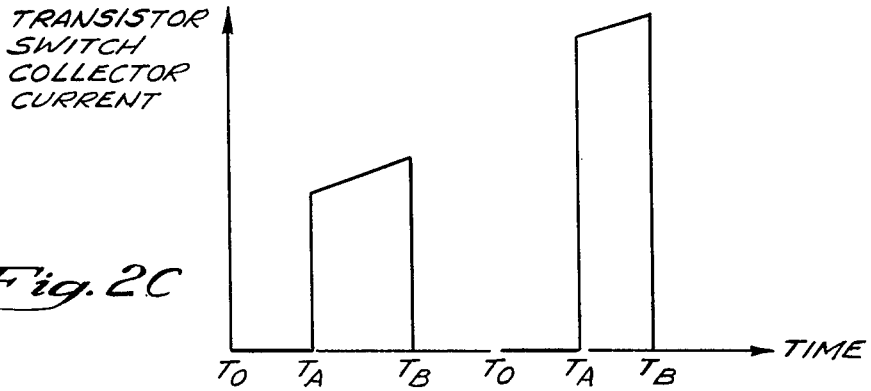
FIG. 2C is a plot of the collector current of the transistor as a function of time.

FIG. 2C is the plot of the collector current of the transistor plotted as a function of time. The collector current amplitude is plotted on the vertical axis and time is plotted on the horizontal axis. In the region denoted A of FIG. 2C, the transistor is off and therefore the collector current remains zero, from time $T_O$ to the end of region A at time $T_A$. In the region denoted B in FIG. 2C, at time $T_A$, the transistor is turned on and remains on until time $T_B$, which defines the end of region B. During this time, the collector current continually increases. At time $T_B$ the transistor is again turned off and the process repeats itself. Thus, the collector current is periodic in time. The current level indicated by the plot is equal to the voltage on the conductor 22 of FIG. 1 divided by the resistance of the resistor 15 in FIG. 1.

Figure 2D:
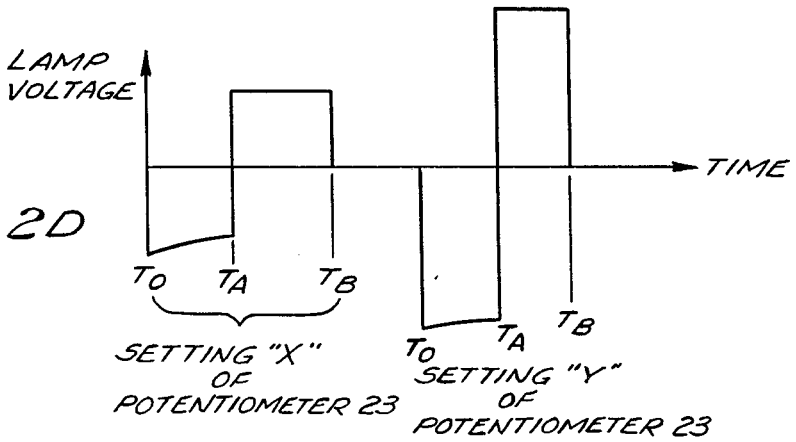
FIG. 2D is a plot of the voltage across the gas discharge lamp as a function of time. In all of these plots, time is plotted on the horizontal axis and the voltage or current is plotted on the vertical axis.

FIG. 2D is a plot of the voltage across the gas discharge lamp as a function of time. It is identical in shape to the lamp current shown in FIG. 2A at the operating frequency of the circuit, i.e., the frequency at which the transistor switch 14 is switched on and off. This frequency is chosen so that its period is short compared to the ionization time of the lamp. A representative operating range is from between 20 to 40 kHz. At this high frequency, the lamp appears electrically to be a resistor. Since the current through a resistor is linearly proportioned to the voltage across it, the lamp voltage and current waveforms are identical in shape.

This high frequency operation has the significant advantage that the weight of the choke, shown in FIG. 1 as 17, may be considerably reduced below the weight of the typical chokes found in the usual fluorescent lamp circuits using 60 Hz AC sources. By way of specific example, a choke suitable for use at 20 kHz will weigh on the order of 4 or 5 ounces whereas the corresponding choke for use at 60 Hz will weigh 4 or 5 pounds.

A feature of the invention is that a selectively variable control over lamp intensity may be provided by the potentiometer 23. The power input to the lamp (and the resultant lamp intensity) are approximately proportional to the average magnitude of the lamp current, which is plotted in FIG. 2A. This plot shows the current reversal during periods when the transistor is turned off, which occurs, for example, at time $T_B$.

Assume that at a particlar setting "X" of the potentiometer 23 in FIG. 1, the voltage on conductor 22 in FIG. 1 is lower than the voltage on the conductor at another setting "Y" of the potentiometer 23. The corresponding changes in the waveforms in FIGS. 2A, 2B, 2C, and 2D between the two settings of the variable resistor for effecting different levels of the lamp intensity are illustrated in these figures. In each figure, the waveform on the left represents setting X and the waveform on the right in each figure represents setting Y.

The manner in which this ocntrol is achieved with potentiometer 23 is as follows.

The peak lamp current always occurs whenever the transistor is turned off, corresponding to times $T_O$ and $T_B$. This occurs whenever the sum of the choke current and lamp current passing through the resistor, denoted 15 in FIG. 1, causes a voltage drop across this resistor equal to the voltage on the conductor, denoted 22 in FIG. 1. As stated above, this occurrence causes the comparator amplifier, 20 in FIG. 1, to give a positive output to the multivibrator, which in turn causes the multivibrator to turn the transistor off.

The current passing through the resistor, 15 in FIG. 1, is the collector current of the transistor. This current is plotted in FIG. 2C, as the sum of the lamp current and choke current in region B.

The peak collector current level is equal to the voltage on the conductor 22 in FIG. 1 divided by the resistance of the resistor, 15 in FIG. 1. When the voltage on the conductor 22 is increased or decreased, the collector current peak level will increase or decrease, respectively. Because the decay time of the current between time $T_O$ and time $T_A$ is always the same, the minimum value of the collector current will also increase or decrease, respectively. Thus, the entire waveform of the collector current will be shifted either up or down, respectively, of which two exemplary waveforms are plotted for the two different potentiometer settings X and Y. The waveforms of the choke current and the lamp current will also be shifted up or down, respectively, as shown. This effect is the result of the fact that the collector current through the transistor is the sum of the choke current and lamp current, and the fact that the lamp current is proportional to the choke current.

Thus, it may be seen that the lamp intensity, which is proportional to lamp current, is proportional to the voltage on the conductor 22. By changing the resistance of the potentiometer 23 in FIG. 1, the current supplied to the lamp 11 will change.

The useful life of the gas discharge lamp is increased in this invention since the net DC component of current through the lamp during continued operation is approximately zero. This is achieved by virtue of the parallel inductance which has the property of maintaining a zero DC voltage drop across its terminals. Since this zero DC voltage is also maintained across the lamp, the DC current through the lamp will also be zero.

Although the circuit is particularly suited for use with low intensity, low pressure mercury vapor fluorescent lamps, it can equally well be used to control various other types of gas discharge lamps such as high pressure mercury vapor, high or low pressure sodium, and metal Halide lamps.

FIG. 3 illustrates a modified embodiment of the invention in which a gas discharge lamp 35, typically a low pressure mercury vapor fluorescent lamp of approximately 22 watts, is provided. The electrodes 38 and 40 are of the heated type. Power is derived from a DC voltage source 16.

An inductor 37 is connected in series with the transistor 14 and resistor 15 across the power supply 36. The electrodes 38 and 40 of lamps 35 are tapped into sections 41 and 42 of the winding of inductor 37 to preheat such electrodes prior to ignition of the lamp.

The inductor 37 also acts as the primary winding of a transformer and has an iron core 39 and a step-down secondary winding 43 associated therewith. The winding 43 is connected in circuit with a diode 44 across a capacitor 45. The diode 44 is also connected through line 46 to the power input terminals of the comparator amplifier 20 and multivibrator 18. It is also used to supply the reference voltage to the potentiometer 23.

The sections 41 and 42 of the winding of inductor 37 enable the electrodes 38 and 40 to become heated before the lamp is ignited. This arrangement maximizes electrode life and prevents damage to the electrodes 38 and 40 due to the otherwise excessive rise of temperature at the start of a lamp operation.

The polarity of the winding 43 is preferably such that the capacitor 45 is charged only when the transistor 14 is conducting. This arrangement insures that the particular voltage on capacitor 45 is independent of the variable fly back voltage developed by the inductor 37 when the transistor 14 is cut off.

Figure 4:
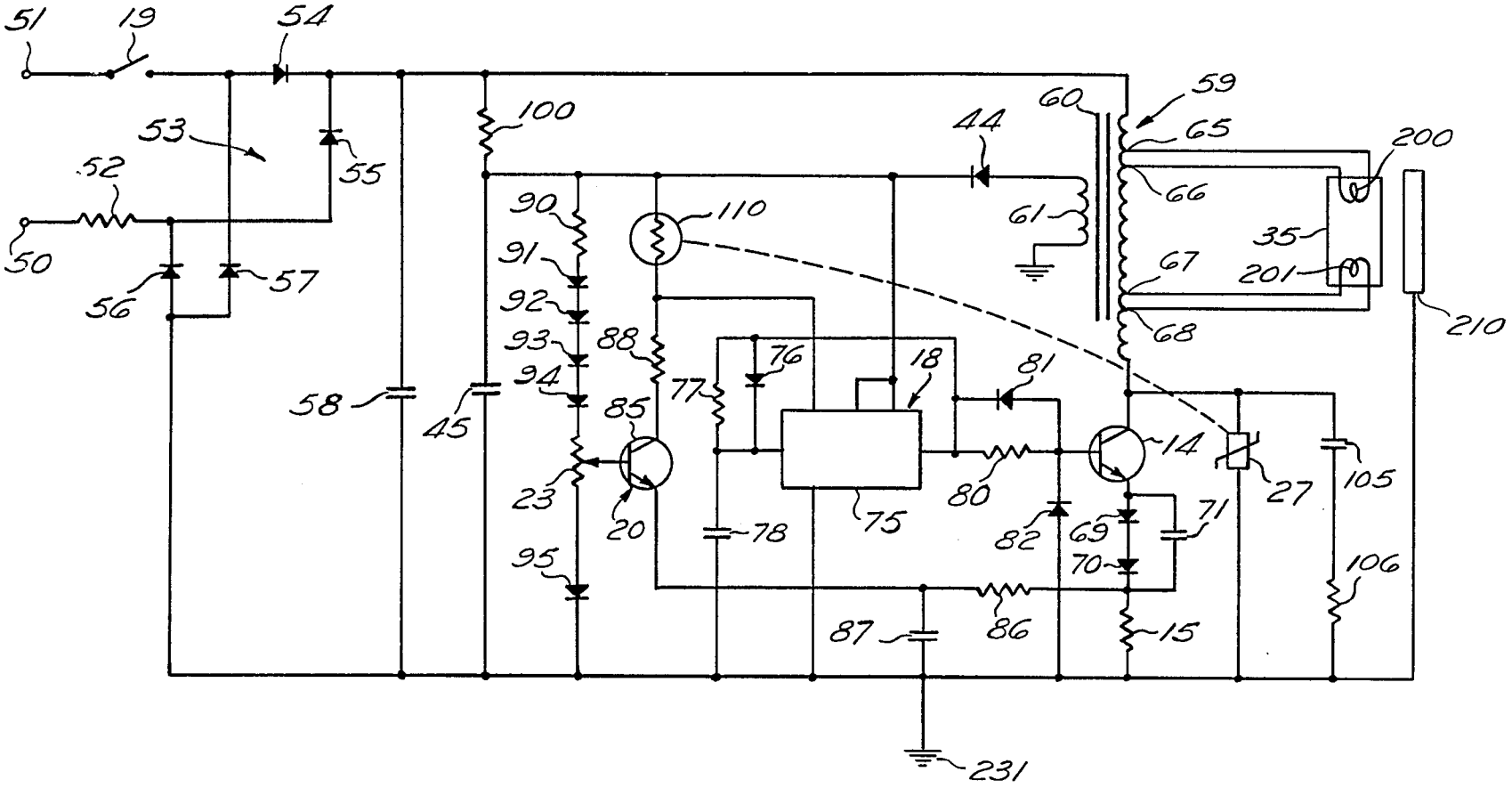
FIG. 4 illustrates a detailed circuit schematic including provision for (a) a step down voltage supply to the lamp for matching the line voltage to the optimal lamp operating voltage and (b) a starting aid adjacent the gas discharge lamp.

FIG. 4 illustrates a detailed circuit schematic showing a number of circuit elements which were deleted from the simplified circuits described above to facilitate understanding of the overall oepration of the invention. In addition, this figure illustrates several significant additional features of the invention.

The circuit of FIG. 4 is designed to operate from a standard 120-volt AC line connected to terminals 50 and 51. These terminals respectively connect to on-off switch 19 and current limiting resistor 52 to a full-wave diode bridge rectifier 53 comprising diodes 54, 55, 56, and 57. The DC output of this rectifier is connected across a wave smoothing capacitor 58. The negative bridge terminal is connected to ground and the positive bridge terminal is connected to one end of an auto-transformer winding 59 having a magnetic core 60, and secondary winding 61.

In the illustration, winding 59 functions as a voltage reducing auto-transformer with one of the lamp electrodes connected to respective mid-taps 65 and 66 and the other lamp electrode connected to taps 67 and 68 located at the end of the winding. The purpose of the auto transformer is to match the DC power supply with the optimum voltage characteristic of the lamp. For example, the output of the diode bridge 53 is approximately 168 volts DC with 120-volt AC input. The optimum voltage for a 22-watt fluorescent lamp is, however, typically only 55 volts. Accordingly, the auto-transformer winding is selected so that the step-down turns ratio is 168 divided by 55. It will be understood that if the optimum lamp operating voltage is larger than the DC power source voltage, a step-up auto-transformer would advantageously be used to supply the stepped up voltage in the same manner.

The collector of NPN switch transistor 14 is connected to the end terminal 68 of the auto-transformer winding 59. Its emitter is connected through a pair of diodes 69 and 70 and resistor 15 to ground. A capacitor 71 parallels the series connected diodes 69 and 70. Capacitor 71 is charged during steady state operation such that the combination of the capacitor 71 and diodes 69 and 70 back bias the transistor emitter.

Integrated circuit 75, diode 76, resistor 77, and capacitor 78 comprise one-shot multivibrator 18. The power supply for this one-shot multivibrator is provided by the secondary winding 61, diode 44, and capacitor 45 as described above with reference to the circuit of FIG. 3.

The base of transistor switch 14 is connected to the output of the one-shot multivibrator 18 through parallel connected resistor 80 and diode 81. Resistor 80 serves as a base current limiting resistor and shunting diode 81 serves to short out this resistor and provide a low impedance path for the charge stored in transistor 14 when the transistor is turned off. The base is also connected to ground through diode 82.

Comparator amplifier 20 comprises transistor 85 whose emitter is connected to the junction of diode 70 and resistor 15 through an RC filter comprising resistor 86 and capacitor 87. Its base is connected to potentiometer 23 and its collector is connected to the input of one-shot multivibrator 18 through resistor 88.

Potentiometer 23 is connected in series circuit with the resistor 90 and diodes 91, 92, 93, 94, and 95. Resistor 90 reduces the sensitivity of potentiometer 23. Diodes 91 through 94 protect the circuit against transients when the on-off switch 19 is initially closed and diode 95 compensates for the base-emitter drop of comparator transistor 20. As in the embodiment of FIG. 3, the reference voltage for potentiometer 23 is provided by the output of secondary winding 61. The RC filter comprising resistor 86 and capacitor 87 serves to prevent a voltage or current transient from affecting comparator transistor 20 and inadvertently triggering the one-shot multivibrator 18.

A resistive path directly connecting the positive terminal of the diode bridge 53 to the power supply provided by secondary winding 61 is provided by resistor 100. This resistor serves as a current bleeder resistor to provide start-up power when the on-off switch 19 is initially closed.

Capacitor 105 and resistor 106 function in parallel with varistor 27 as a snubber protective circuit for protecting the transistor 14 from the inductive auto-transformer load when the transistor is being turned off.

Another significant feature of the circuit of FIG. 4 is the inclusion of thermistor 110 electrically connected between the input of one-shot multivibrator 18 and the positive side of the power supply capacitor 45. The thermistor is mechanically and thermally attached to the varistor 27 as indicated by the dotted line. The varistor has a negative temperature coefficient selected such that when a transient surge in the circuit causes the varistor to begin to overheat, the thermistor will become highly conductive and act to hold the input of the one-shot multivibrator high, thereby maintaining the transistor 14 in the off state. Thus, the circuit illustrated in FIG. 4 will remain effectively shut down until such time as the varistor 27 has a chance to cool. Accordingly, it will be seen that thermistor 48 prevents overheating of the varistor 27.

An exemplary circuit for operation of a 22-watt fluorescent lamp from 120-volt AC power in accordance with FIG. 4 has the following circuit components:

| | |
|---|---|
| Transistor 14 | MJE 13004 (Motorola) |
| Resistor 15 | 2.2 ohm |
| Potentiometer 23 | 200 ohm |
| Varistor 27 | V275LA 20 (General Electric) |
| Resistor 52 | 1.5 ohm |
| Diodes 54–57 | IN4003 |
| Capacitor 58 | 100 Micro farad |
| Winding 59 | 263 + 6 + 150 + 6 turns |
| Core 60 | Ferroxcube 376U250-3c8 and 376B250-3c8 |
| Winding 61 | 41 Turns |
| Diodes 69, 70, 76, 81, 82, 91–95 | IN4148 |
| Capacitor 71 | 10 Micro farad |
| Integrated Circuit 75 | NE 555 V |
| Resistor 77 | 10K ohm |
| Capacitor 78 | .0033 Micro farad |
| Resistor 80 | 200 ohm |
| Transistor 85 | 2N 3904 |
| Resistor 86 | 22 ohm |
| Capacitor 87 | .1 Micro farad |
| Resistor 90 | 1.3K ohm |
| Resistor 100 | 20K ohm |
| Capacitor 105 | 560 Pico farad |
| Resistor 106 | 220 ohm |
| Thermistor 110 | 4C5002 (Western Thermistor) |

In the circuit of FIG. 4, the fly back voltage across the electrodes 200,201 caused by switching the transistor 14 off must be sufficiently high to light the lamp when the switch 19 is first closed. The voltage occurring in the circuit when the transistor 14 is first turned off, corresponding to time $T_B$ in FIG. 2a, will be referred to as the fly back voltage. Ignition of the lamp requires that the fly back voltage between the two electrodes 200,201 in the lamp 35 be sufficiently high, and the distance between the electrodes 200,201 be sufficiently small so that the resulting voltage gradient in the lamp 35 has sufficient magnitude to cause the gas inside the lamp 35 to ionize. The term "voltage gradient" is understood to be the voltage drop per unit distance. It is well known that, for a gas which may be used in a gas discharge lamp, there is a threshold voltage gradient below which ionization of the gas cannot be achieved.

The voltage gradient near the electrode 201 at ignition of the lamp is proportional to the fly back voltage across the two electrodes 200,201 divided by the distance between the electrodes 200,201. The large fly back voltages which are typically required may have deliterious effects upon the transistor 14, and therefore upon the reliability of the circuit of FIG. 4. It is this concern for the reliability of the circuit of FIG. 4 that prompts the use of varister 27, the thermister 110, and the capacitor 105.

As mentioned above, it is well known that commercially available gas discharge lamps operate most efficiently at a certain optimum supply voltage. In order to match the line voltage with this optimum lamp voltage, an auto transformer may be used as shown in FIG. 4. The auto transformer 59 has a step down ratio which is proportional to the number of turns in the winding of the auto transformer 59 between the taps 66 and 67 divided by the total number of turns in the entire winding.

Introduction of the auto transformer 59 causes a reduction in the fly back voltage between the electrodes 200,201. Therefore, in order to provide a threshold voltage gradient in the lamp 35 sufficient to ignite the lamp when the switch 19 is first closed, the fly back voltage must be increased. This increase in fly back voltage may be achieved by increasing the breakdown voltage of the varistor 27. Otherwise, when the switch 19 is closed, the lamp 35 may not ignite. This increase in fly back voltage, however, increases the likelihood of harm to the transistor 14 and decreases the reliability of the circuit of FIG. 4.

In this invention, these difficulties are overcome by connecting a starter aid 210, as shown in FIG. 4 to ground 231, and locating the starter aid 210 adjacent the lamp 35. The starter aid 210 is merely an elongate conductor which is preferably mounted parallel to and within one inch of the lamp 35. It may, for example, be a thin strip of metal mounted on the outside of the lamp 35.

The starting aid 210 acts to increase the voltage gradient near the electrode 201 when the transistor 14 is first opened to produce a fly back voltage in the circuit. Because this fly back voltage is the largest voltage in the circuit, it is used to ignite the lamp. In the absence of the starter aid conductor 210, the voltage gradient created in the lamp by the fly back voltage is inversely proportional to the distance between the electrodes 200 and 201. However, when the starter aid conductor 210 is connected to ground 231 and held adjacent to the lamp 35, it provides a voltage gradient between the electrode 201 and the starting aid conductor 210. This voltage gradient is much larger than the voltage gradient created in the absence of the starter aid conductor 210 between the electrode 201 and the electrode 200 because the distance between the electrode 201 and the starting aid conductor 210 is much less than the distance between the electrode 201 and the electrode 200.

When the switch 19 is closed, the transistor 14 is first closed and then opens to cause the fly back voltage in the manner described earlier in this specification. The fly back voltage between the terminal 68 and ground 231 results in a large voltage gradient between the electrode 201 and the starter aid conductor 210. Of course, another voltage gradient will appear between the electrode 200 and the starter aid conductor 210, but because the fly back voltage at the electrode 200 is reduced by the step down transformer 59, the voltage gradient in the vicinity of the electrode 201 is larger.

Figure 6:
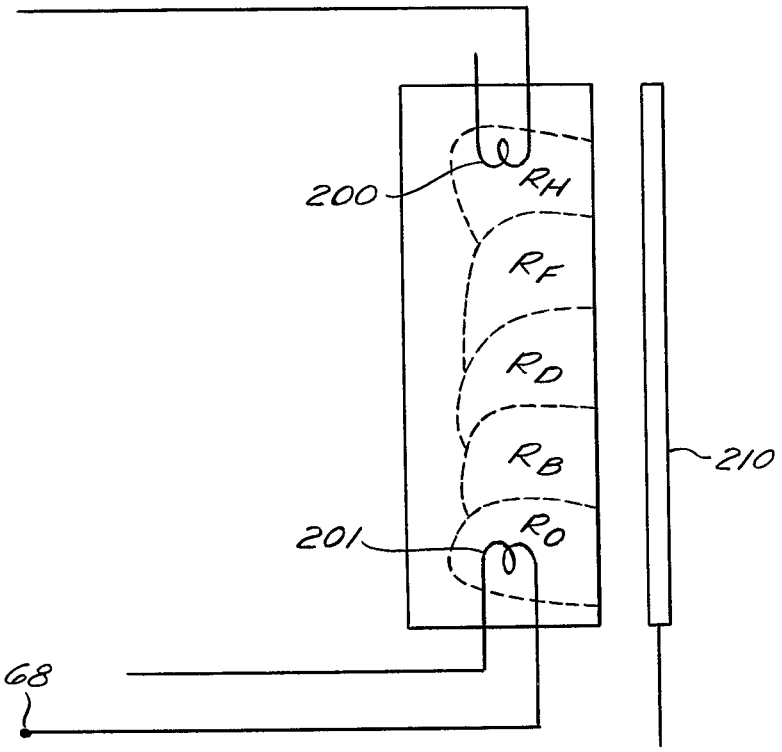
FIG. 6 is a schematic illustration of the progressive ionization of the gas in the gas discharge lamp during start up.

Preferably, the maximum voltage gradient which appears at the electrode 201 is just sufficient to ionize the gas in the vicinity of the electrode 201. However, because this maximum voltage gradient is restricted to a limited vicinity around the electrode 201, ionization will occur in this limited area only. However, during subsequent operation of the circuit, the vicinity of ionization will progressively expand, as best illustrated in FIG. 6. Assuming that the transistor 14 has opened to cause the fly back voltage at time $T_O$ of FIG. 2a, the transistor will again close at time $T_A$ and the fly back voltage will disappear. The transistor again opens at time $T_B$ and a fly back voltage again appears. The ionized gas which was created by the first fly back voltage at time $T_O$ does not totally deionize between $T_A$ and time $T_B$, the interval between fly back voltages, but substantially remains in the vicinity of the electrode 201, which is illustrated in FIG. 6 as the outlined region designated $R_O$. During the next fly back voltage at $T_B$, the ionized gas in the region $R_O$ acts substantially as a conductor. Therefore, a large voltage gradient is created by the fly back voltage at time $T_B$ and appears between the entire region $R_O$ and the starter aid conductor 210. This large voltage gradient is sufficient to cause further ionization, and this causes the region of ionization to expand from the smaller region $R_O$ to the larger region $R_B$. Again, the cycle repeats itself, and this time the fly back voltage gradient appears between the conducting ionized gas in the expanded region $R_B$ and the starter aid conductor 210, which causes the region of ionized gas to further expand until it encompasses the region $R_D$.

It is seen that, through successive cycles, the region of ionized gas expands progressively, beginning in the smaller region $R_O$, then regions $R_B$, $R_D$, $R_F$, and finally encompasses the region $R_H$ which includes the second electrode 200 and establishes a conducting ionized gas electrical current path between the electrodes 200 and 201, at which time the ignition of the lamp 35 is complete. It may also be seen that the fly back voltage of the terminal 68 required to ignite the lamp may be relatively small to increase the reliability of the circuit.

It is significant that in the circuit of FIG. 4, the location of the taps 65, 66, 67, and 68 on the auto transformer 59 is arbitrary, and the electrodes 200,201 may be connected across any segment of the auto transformer 59 which gives the proper step down ratio without affecting the operation of the lamp 35 after ignition. For example, the lamp 35 may be connected across the top half of the auto transformer, or the lamp may be connected across the intermediate segment of the auto transformer 59. However, as pointed above, the auto transformer 59 causes a reduction in the fly back voltage between the electrodes 200,201. A similar reduction in fly back voltage between the electrode 201 and ground 231, which generates the starting voltage gradient between the electrode 201 and the starter aid conductor 210, is present in the circuit of FIG. 4 due to the step down auto transformer 59. It is desirable to eliminate any reduction of the voltage between the electrode 201 and the conductor 210 by the auto transformer 59, so that the voltage gradient near the electrode 201 may be maximized when the transistor 14 first opens to create a fly back voltage to ignite the lamp 35.

Figure 5:
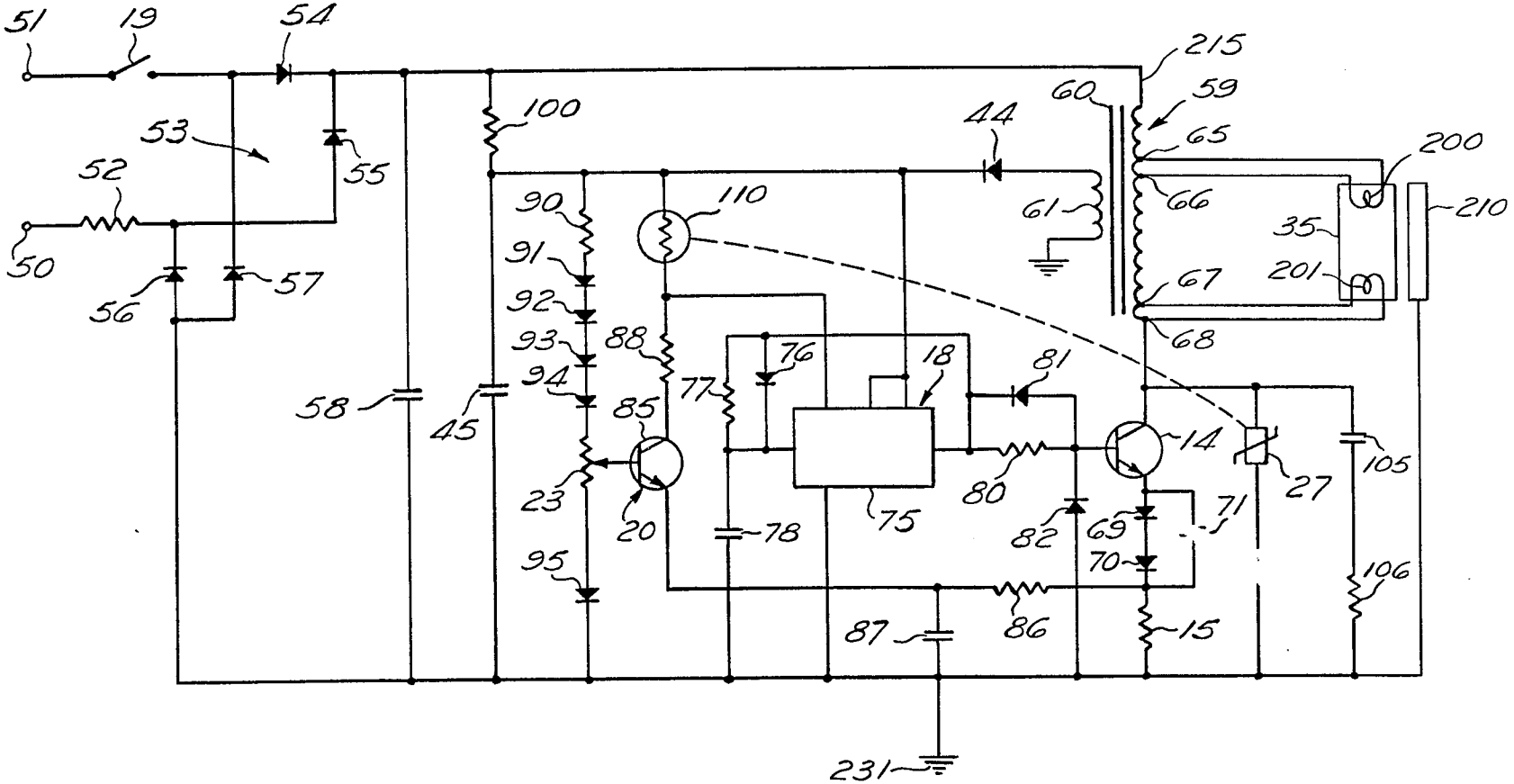
FIG. 5 illustrates the preferred embodiment of this invention in which the connection of the gas discharge lamp and the connection of the starter aid maximizes the starting voltage supplied to the lamp.

The circuit of FIG. 5 eliminates any reduction of the voltage gradient between the electrode 201 and the conductor 210 by the auto transformer 59. The operation of the circuit of FIG. 5 is similar to that of FIG. 4 except that the corresponding voltage gradient at the electrode 201 caused by the fly back voltage between the electrode 201 and the conductor 210 is maintained at the threshold level required for ignition without regard to the selection of the step down ratio of the auto transformer 59. The electrode 201 in FIG. 5 is connected directly to rhw terminal 68 connecting the transistor 14 to the auto transformer 59 while the other electrode 200 is connected to a mid-tap on the auto transformer 59 such as the mid-tap 66. Such a direct connection prevents the fly back voltage between the starter aid 210 and the electrode 201 from being reduced by the step down auto transformer 59.

Unless the electrode 201 is connected to the collector of the transistor 14 as shown in FIG. 5 and the starter aid conductor 210 is used, the largest voltage gradient inside the lamp 35 at ignition is approximately proportional to the fly back voltage appearing across the terminal 68 and ground 231 reduced by the auto transformer 59 and divided by the relatively large distance between the electrodes 201,200. It is now apparent that introduction of the starter aid conductor 210 permits a much smaller fly back voltage to be used which can nevertheless cause a sufficiently large voltage gradient between the electrode 201 and the starter aid conductor 210 to achieve ionization of the gas in the lamp 35 and ignition of the lamp when the switch 19 is first closed. Furthermore, through proper connection of the auto transformer to the lamp, as shown in FIG. 5, an auto transformer of any step down ratio may be used without affecting this voltage gradient. It should be recognized that a step up auto transformer for increasing the voltage supplied to the lamp 35 may also be used in place of the step down auto transformer 59 of FIG. 5.

What is claimed is:

1. A circuit for energizing a gas discharge lamp comprising:

first means for storing magnetic energy, said means connectable across a power source, at least a portion of said first means connected in parallel combination with the electrodes of said gas discharge lamp, the extent of said portion, in comparison with the overall storing means, defining a voltage transforming ratio;

second means for connecting a power supply to said parallel combination;

third means operatively coupled to said second means for interrupting the connection between said power supply and said parallel combination for a predetermined length of time whenever the current through said parallel combination has increased to a predetermined level; and fourth external conductor means for increasing the voltage gradient inside said lamp during ignition of said gas discharge lamp independently of said voltage transforming ratio.

2. A circuit for energizing a gas discharge lamp, as defined in claim 1, wherein:

said fourth external conductor means comprises a starter aid conductor adjacent one of said electrodes, said conductor grounded to one side of said power supply.

3. A circuit for energizing a gas discharge lamp as defined in claim 1 wherein said first means comprises a step down autotransformer.

4. Apparatus for energizing a gas discharge lamp having a pair of electrodes which comprises:

a voltage supply having two terminals;

a switching device;

a resistor;

an inductor having two connection ends;

means connecting said inductor, said switching device and said resistor in series across said two terminals, said switching device connected between said resistor and said inductor, said two terminals connected to said resistor and said inductor, respectively;

means connecting said pair of electrodes in parallel combination with at least a portion of said inductor;

a one-shot multivibrator having a first variable time output state and a second fixed time output state;

means connecting the output of said multivibrator to said switching device to close said switching device during said first output state and to open said switching device during said second output state;

means for putting said multivibrator in said second state when the voltage across said resistor reaches a predetermined level; and a starter aid conductor located adjacent said lamp, extending parallel to the gap between said two electrodes, said conductor connected to one of said terminals of said AC voltage supply.

5. An apparatus for energizing a gas discharge lamp, as defined in claim 4, wherein:

said portion of said conductor which is connected in parallel combination with said pair of electrodes includes the end of said inductor which is connected to said switching device.

6. An apparatus for energizing a gas discharge lamp, as defined in claim 4, wherein:

said starter aid conductor is connected to the terminal of said voltage supply which is connected to said resistor.

7. An apparatus for energizing a gas discharge lamp, as defined in claim 4, wherein:

the distance between said two electrodes and said starter aid conductor is sufficiently small so that at least some of the gas in said gas discharge lamp is ionized whenever said multivibrator first enters said second state to open said switching device to ignite said lamp.

8. A circuit for energizing a gas discharge lamp comprising:

first means for storing magnetic energy, at least a portion of said first means connected in parallel combination with the electrodes of the gas discharge lamp;

second means for connecting a power supply to said parallel combination;

third means operatively coupled to said first and second means for interrupting the connection between said power supply and said parallel combination for a predetermined length of time whenever the current through said parallel combination has increased to a predetermined level;

fourth means for stepping down the voltage supplied to said electrodes by said power supply in a desired step down ratio; and fifth means for providing an increase in the voltage gradient near one of said electrodes in said lamp when said lamp is initially ignited, said increase independent of the step down ratio of said fourth means.

9. A circuit for energizing a gas discharge lamp as defined in claim 8 wherein said fourth means comprises a center tap on said first means, said tap defining said portion of said first means, said center tap connected to one of said electrodes.

10. A circuit for energizing a gas discharge lamp as defined in claim 9 wherein said fifth means comprises a conductor adjacent said lamp and adjacent to at least the other of said electrodes, said conductor connected to said return of said power supply, and wherein the fifth means further comprises a connection between said other electrode and the junction between said third means and said first means so that said voltage gradient is unaffected by said fourth means.

11. A circuit for energizing a gas discharge lamp comprising:

a gas discharge lamp having two electrodes;

a step down auto transformer driving said lamp;

a power supply means providing intermittent current to said step down transformer; and means for providing a starting voltage gradient between one of said electrodes and said power supply and for establishing the magnitude of said starting voltage gradient independently of said step down auto transformer.

* * * * *